US012235082B1

(12) United States Patent
Garcia et al.

(10) Patent No.: US 12,235,082 B1
(45) Date of Patent: Feb. 25, 2025

(54) DEPLOYABLE ORIGAMI STRUCTURE

(71) Applicant: Government of the United States, as represented by the Secretary of the Air Force, Wright-Patterson AFB, OH (US)

(72) Inventors: David J. Garcia, Rock Hill, SC (US); Robert A. Bettinger, Oakwood, OH (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 0 days.

(21) Appl. No.: 18/422,173

(22) Filed: Jan. 25, 2024

Related U.S. Application Data

(60) Provisional application No. 63/536,087, filed on Sep. 1, 2023.

(51) Int. Cl.
*F41H 5/013* (2006.01)

(52) U.S. Cl.
CPC ..... *F41H 5/013* (2013.01)

(58) Field of Classification Search
CPC ..... B64G 1/222; F41H 5/013
See application file for complete search history.

(56) References Cited

U.S. PATENT DOCUMENTS 3,848,821 A * 11/1974 Scheel ..... E04H 15/26 242/899
4,144,057 A * 3/1979 Melton ..... C22F 1/006 148/563
4,949,490 A * 8/1990 Miller ..... G09F 15/0068 40/605
5,114,504 A * 5/1992 AbuJudom, II ..... C22F 1/006 420/451
5,392,686 A * 2/1995 Sankar ..... F41H 5/08 109/49.5
7,730,925 B1 * 6/2010 Pereira ..... E06B 9/262 160/348
8,646,372 B1 * 2/2014 Lee ..... F41H 5/08 89/36.07
10,347,962 B1 * 7/2019 Georgakopoulos .... H01Q 1/362
10,351,195 B1 * 7/2019 Schieffelin ..... B62J 7/04
10,833,392 B1 * 11/2020 Zekios ..... H01Q 15/0013
10,899,479 B2 * 1/2021 Cahoy ..... F03G 7/065
11,533,018 B2 * 12/2022 Magleby ..... H02S 30/20
11,881,811 B2 * 1/2024 Nakagawa ..... H02S 30/20
(Continued)

OTHER PUBLICATIONS

Kordalis, A.; Glynn, G.; Zhang, J.; Hu, E.; Yuan, D.; Design Packet Folding Solar Panel Origami using Shape Memory Alloys, 2021, 1-74.

(Continued)

*Primary Examiner* — Joshua E Freeman
(74) *Attorney, Agent, or Firm* — AFMCLO/JAZ; James F. McBride

(57) ABSTRACT

The present invention relates to deployable origami structures and methods of making and using same. Such deployable origami structures can be folded into a compact state utilizing origami, yet easily deployed as the structures comprise pseudo-elastic connectors. Additive manufacturing techniques can be used to make such deployable origami structures as such techniques can lower cost and structure weight.

20 Claims, 4 Drawing Sheets

(56) References Cited

U.S. PATENT DOCUMENTS

| | | | | |
|---|---|---|---|---|
| 11,965,491 | B2 * | 4/2024 | Song | F03G 7/0616 |
| 2004/0222938 | A1 * | 11/2004 | Gierow | H01Q 1/081 343/872 |
| 2008/0309122 | A1 * | 12/2008 | Smith | B62D 35/001 296/180.1 |
| 2011/0084516 | A1 * | 4/2011 | Smith | B62D 35/001 296/180.4 |
| 2013/0067907 | A1 * | 3/2013 | Greene | C22F 1/006 148/563 |
| 2015/0060193 | A1 * | 3/2015 | Thun | E04B 9/34 181/286 |
| 2017/0291819 | A1 * | 10/2017 | Cho | G03F 7/40 |
| 2017/0294698 | A1 * | 10/2017 | Cho | C23C 28/345 |
| 2018/0155018 | A1 * | 6/2018 | Kovac | B64U 30/26 |
| 2018/0278200 | A1 * | 9/2018 | Jeon | H02S 30/20 |
| 2019/0226814 | A1 * | 7/2019 | Howell | E01F 13/02 |
| 2020/0037771 | A1 * | 2/2020 | Ketels | A47B 23/002 |
| 2020/0256647 | A1 * | 8/2020 | Howell | F41H 5/0407 |
| 2021/0013614 | A1 * | 1/2021 | Georgakopoulos | H01Q 1/288 |
| 2024/0164359 | A1 * | 5/2024 | Zhu | A01K 91/04 |
| 2024/0186944 | A1 * | 6/2024 | Hafter | F24S 80/453 |
| 2024/0270412 | A1 * | 8/2024 | Bacon | B64G 1/2224 |
| 2024/0283398 | A1 * | 8/2024 | Sheffield | H02S 20/30 |

OTHER PUBLICATIONS

Schenk, M.; Origami in Engineering and Architecture An art and science spanning Mathematics, Engineering and Architecture, 2012, 1-11.

Cook, A. E.; Thesis, Concept Of Operations Of Cislunar Mirror Satellites To Provide Augmented Lighting Of Dim Space-Based Objects, 2023, 1-126.

Zirbel, S. A., Lang, R. J., Thomson, M. W., Sigel, D. A., Walkemeyer, P. E., Trease, B. P., Magleby, S. P., and Howell, L. L.; , "Accommodating Thickness in Origami-Based Deployable Arrays," Journal of Mechanical Design, vol. 135, 2013, pp. 1-11.

Lang, R. J., Magleby, S., and Howell, L.; "Single-Degree-of-Freedom Rigidly Foldable Cut Origami Flashers," Journal of Mechanisms and Robotics, 2016, 8, 1-15.

Zirbel, S. A .; Trease, B. P.; Magleby, S. P.; Howell, L. L.; Deployment Methods for an Origami-Inspired Rigid-Foldable Array, Proceedings of the 40th Aerospace Mechanisms Symposium, NASA Goddard Space Flight Center, 2014, 189-194.

Guest S. D.; Pellegrino, S.; Inextensional Wrapping Of Flat Membranes, R. Motro & T. Wester, Structural Morphology / Morphologie Structurale, Proceedings of the First International Seminar on Structural Morphology, Montpellier, 1992, 203-215.

Horvath, L.; Reviewing and Evaluating Pattern-Generation and Fabrication Methodologies for an Origami, Flasher, Thesis, University of Toledo, 2017, 1-71.

Bettini, P.; Rigamonti, D.; Sala, G.; Shape Memory Alloy Engineering 2nd, For Aerospace, Structural, and Biomedical Applications, 2021, Chapter 16, 561-590.

Chung, D.D.L.; Carbon materials for structural self-sensing, electromagnetic shielding and thermal interfacing, Carbon, 2012, 50, 3342-3353.

Safety Data Sheet, Nitinol Alloys, SAES Group, 2014, 1-8.

David J. Garcia, D. J.; Bettinger, R. A.; Attitude Control Analysis of Space-Based Mirror Satellites for Illuminating Dimly-Lit Resident Space Objects, AIAA SciTech Forum 2024, Jan. 8-12, 2024, Orlando, FL, 1-10.

David J. Garcia, D. J.; Bettinger, R. A.; Hartsfield, C.; Simulated Debris Impact Testing of Additively Manufactured Origami Mirror Structure for Space-Based SSA, Advanced Maui Optical and Space Surveillance Technologies (AMOS) Conference, Sep. 19, 2023, 1-11.

David J. Garcia, D. J.; Bettinger, R. A.; Attitude Control Analysis of Space-Based Mirror Satellites for Illuminating Dimly-Lit Resident Space Objects, Presentation at AIAA SciTech Forum 2024, Jan. 8-12, 2024, Orlando, FL, 1-19.

David J. Garcia, D. J.; Bettinger, R. A.; Hartsfield, C.; Poster Presentation: Simulated Debris Impact Testing of Additively Manufactured Origami Mirror Structure for Space-Based SSA, Advanced Maui Optical and Space Surveillance Technologies (AMOS) Conference, Sep. 19, 2023, 1.

* cited by examiner

DEPLOYABLE ORIGAMI STRUCTURE

CROSS-REFERENCE TO RELATED APPLICATIONS

The present application claims priority to U.S. Provisional Application Ser. No. 63/536,087 filed Sep. 1, 2023, the contents of such provisional application hereby being incorporated by reference in its entry.

RIGHTS OF THE GOVERNMENT

The invention described herein may be manufactured and used by or for the Government of the United States for all governmental purposes without the payment of any royalty.

FIELD OF THE INVENTION

The present invention relates to deployable origami structures and methods of making and using same.

BACKGROUND OF THE INVENTION

Origami structures are structures that can be folded into a compact design. Thus, such structures can be advantageous when space is at a premium. This particularly true with respect to lighting for Resident Space Objects (RSOs), radar applications, solar panels, shielding, such as thermal shielding, laser shielding, light shielding, and/or ballistic shielding as well as camouflage.

Unfortunately, the mechanical hinges that connect the panels of current structures can stick, cold weld or jam thus resulting in a structure that does not correctly unfold. In addition, such hinges often require lubricants etc. in order to unfold properly. An example of such problems can be found in the Galileo probe communications antenna that that did not correctly unfold. Applicants recognized that the problem associated with such mechanical hinges was not only that such hinges comprise multiple pieces but that such hinges are formed from materials that cannot go back to their pre-folded shape as they are not pseudo elastic. Here, Applicants disclose origami structures that comprise connections that minimize the aforementioned hinge issue.

SUMMARY OF THE INVENTION

The present invention relates to deployable origami structures and methods of making and using same. Such deployable origami structures can be folded into a compact state utilizing origami, yet easily deployed as the structures comprise pseudo elastic connectors. Additive manufacturing techniques can be used to make such deployable origami structures as such techniques can lower cost and structure weight.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

Figure 1:
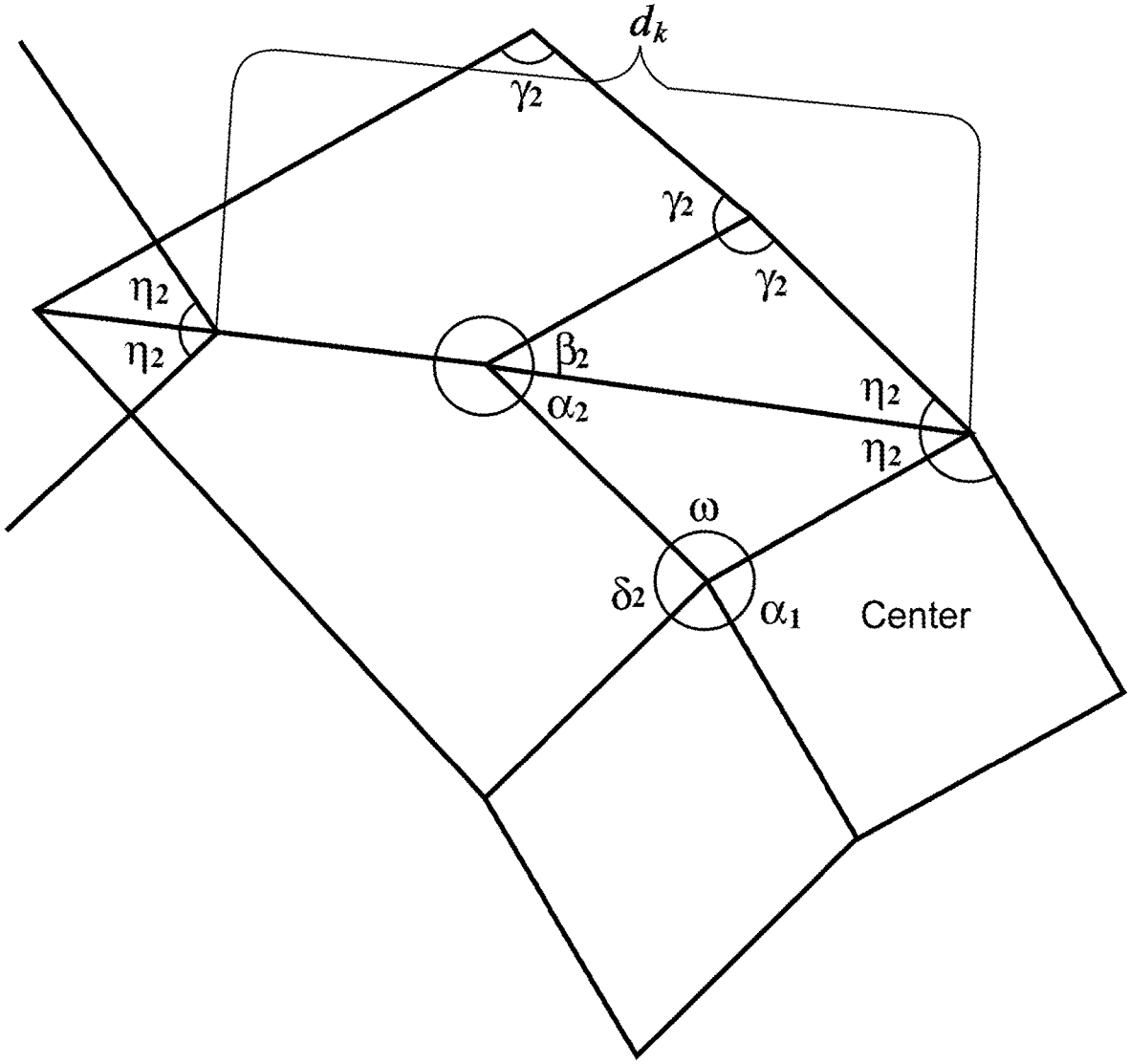
FIG. 1 Depicts the angles present in the design.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

Definitions

Unless specifically stated otherwise, as used herein, the terms "a", "an" and "the" mean "at least one".

As used herein, the terms "include", "includes" and "including" are meant to be non-limiting.

As used herein, the words "about," "approximately," or the like, when accompanying a numerical value, are to be construed as indicating a deviation as would be appreciated by one of ordinary skill in the art to operate satisfactorily for an intended purpose.

As used herein, the words "and/or" means, when referring to embodiments (for example an embodiment having elements A and/or B) that the embodiment may have element A alone, element B alone, or elements A and B taken together.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Deployable Origami Structure and Articles Comprising Same

For purposes of this specification, headings are not considered paragraphs. In this paragraph, Applicants disclose a deployable origami structure comprising a plurality of panels and connectors, said connectors connecting each panel to at least one other panel in at least two spots, said connectors comprising an alloy that has the following properties a melting point that is greater than 1000° C. and a relative density of 6.4 g/cm$^3$, preferably said alloy comprises from about 40% to about 60% nickel, less than 3% Copper, Niobium or Cobalt the balance of said alloy being Titanium, more preferably said alloy comprises less than 3% Niobium or Cobalt, most preferably said alloy comprises less than 3%

Cobalt 3%. In one aspect, said alloy comprises from about 0.1% to about 3% Copper, Niobium or Cobalt. In another aspect, said alloy comprises from about 1% to about 3% Copper, Niobium or Cobalt. In one aspect, said alloy may comprise a total of from about 0.10% to about 3% Copper, Niobium and/or Cobalt. In one aspect, said alloy may comprise a total of from about 1% to about 3% Copper, Niobium and/or Cobalt.

In this paragraph, Applicants disclose the deployable origami structure of the previous paragraph wherein said connectors are in the form of wires and/or sheets.

In this paragraph, Applicants disclose the deployable origami structure of the previous two paragraphs wherein said panels comprise a mirror material, an electromagnetic shielding material, a radar absorptive material, a thermal shielding material, a solar panel material, a laser shielding material, a light shielding material, a ballistic shielding material and/or a thermal camouflage material, in one aspect said material is disposed on one side of said panels.

In this paragraph, Applicants disclose the deployable origami structure of the previous paragraph wherein said mirror material comprising Aluminum, Copper, Silver and/or Gold; said electromagnetic shielding material comprises graphite and nickel-coated carbon composite fibers; said radar absorptive material comprises a polymer matrix comprising embedded ferromagnetic particles; said thermal shielding material comprises carbon nanofibers and/or ceramics; said solar panel material comprises silicon and aluminum; said laser shielding material comprises polycarbonates and/or acrylics; said light shielding material comprises Kapton and/or vinyl polyester; said ballistic shielding material comprises Kevlar and/or ceramics; and said thermal camouflage material comprises samarium nickel oxide and/or a phase-change material, preferably said phase-change material comprises vanadium oxide and/or $Ge_3Sb_2Te_6$.

In this paragraph, Applicants disclose the deployable origami structure of the previous four paragraphs wherein said panels are: squares and triangles, in one aspect said squares comprise 1 to 3 rounded corners; rectangles and triangles, in one aspect said rectangles comprise 1 to 3 rounded corners; trapezoids, squares and triangles, in one aspect said trapezoids and/or squares comprise 1 to 3 rounded corners; or trapezoids, rectangles and triangles, in one aspect said trapezoids and/or rectangles comprise 1 to 3 rounded corners.

In this paragraph, Applicants disclose the deployable origami structure of the previous five paragraphs wherein said connectors are glued, welded and/or crimped to said panels or within to said panels.

In this paragraph, Applicants disclose an article comprising the deployable origami structure of the previous six paragraphs, said article being an aerospace vehicle, preferably said aerospace vehicle is a satellite, preferably said satellite is an inspector CubeSat, or an Evolved Expendable Launch Vehicle Secondary Payload Adapter Satellite; or a land vehicle preferably said land vehicle is a main battle tank, infantry fighting vehicle, armored personnel vehicle, armored combat support vehicle, mine protected vehicles, light armored vehicles, light utility vehicles, in one aspect said land vehicle is a M1127 Reconnaissance Vehicle, an Armored Multi-Purpose Vehicle, or a Light combat tactical combat vehicle, but is not limited to any.

Process of Making Deployable Origami Structure

In this paragraph, Applicants disclose a process of making a deployable origami mirror structure said process comprises connecting a plurality of panels with a plurality of connectors, said connectors connecting each panel to at least one other panel in at least two spots, said connectors comprising an alloy that has the following properties a melting point that is greater than 1000° C. and a relative density of 6.4 g/cm$^3$, preferably said alloy comprises from about 40% to about 60% nickel, less than 3% Copper, Niobium or Cobalt the balance of said alloy being Titanium, more preferably said alloy comprises less than 3% Niobium or Cobalt, most preferably said alloy comprises less than 3% Cobalt. In one aspect, said alloy comprises from about 0.1% to about 3% Copper, Niobium or Cobalt. In another aspect, said alloy comprises from about 1% to about 3% Copper, Niobium or Cobalt. In one aspect, said alloy may comprise a total of from about 0.1% to about 3% Copper, Niobium and/or Cobalt. In one aspect, said alloy may comprise a total of from about 1% to about 3% Copper, Niobium and/or Cobalt.

In this paragraph, Applicants disclose the process of the previous paragraph, wherein said connectors are glued, welded and/or crimped to said panels or within to said panels.

In this paragraph, Applicants disclose the process of the previous two paragraphs, wherein said connectors are in the form of wires and/or sheets.

In this paragraph, Applicants disclose the process of the previous three paragraphs, wherein said panels comprise a mirror material, an electromagnetic shielding material, a radar absorptive material, a thermal shielding material, a solar panel material, a laser shielding material, a light shielding material, a ballistic shielding material and/or a thermal camouflage material, in one aspect said material is disposed on one side of said panels.

In this paragraph, Applicants disclose the process of the previous four paragraphs wherein: said mirror material comprising Aluminum, Copper, Silver and/or Gold; said electromagnetic shielding material comprises graphite and nickel-coated carbon composite fibers; said radar absorptive material comprises a polymer matrix comprising embedded ferromagnetic particles; said thermal shielding material comprises carbon nanofibers and/or ceramics; said solar panel material comprises silicon and aluminum; said laser shielding material comprises polycarbonates and/or acrylics; said light shielding material comprises Kapton and/or vinyl polyester; said ballistic shielding material comprises Kevlar and/or ceramics; and said thermal camouflage material comprises samarium nickel oxide and/or a phase-change material, preferably said phase-change material comprises vanadium oxide and/or $Ge_3Sb_2Te_6$.

In this paragraph, Applicants disclose the process of the previous five paragraphs wherein said panels are: squares and triangles, in one aspect said squares comprise 1 to 3 rounded corners; rectangles and triangles, in one aspect said rectangles comprise 1 to 3 rounded corners; trapezoids, squares and triangles, in one aspect said trapezoids and/or squares comprise 1 to 3 rounded corners; or trapezoids, rectangles and triangles, in one aspect said trapezoids and/or rectangles comprise 1 to 3 rounded corners.

Suitable materials for making the aforementioned deployable origami structures can be obtained from McMASTER-CARR at 200 Aurora Industrial Pkwy Aurora, OH 44202-8087, Stratasys at 7665 Commerce Way Eden Prairie, MN 55344, EMF Large Optics Division at 239 Cherry Street Ithaca, NY 14850, and 3M at 1030 Lake Road Medina, OH 44256.

EXAMPLES

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

To generate an STL file suitable for 3D printing, a thickness of 1.27 mm would be chosen to be adequate for the space mirror application. To maximize the available space within a CubeSat, the optimal design includes a center square with a diameter of 42.4 mm while maintaining a constant height. By considering the chosen thickness, center square diameter, and height, specific equations can be applied to design the STL file. For a visual reference, please refer to FIG. 1.

To initiate the design process, we start by determining the inner angles of the hub. Given that n=4 for a square, it is established that the inner angles are equal to 90 degrees. To maintain the entire design as single-degree-of-freedom, it is essential that most, if not all, vertices have a degree of 4. Consequently, we can analyze all the degree 4 vertices around the hub, where the sector angles add up to $2\pi$ (radians). Utilizing the following equation, angle $\alpha$ can be calculated.

$$\alpha = \frac{\pi}{2} - \frac{\pi}{n}$$

where n is the number of sides to the center hub. Furthermore, let's consider the next angle in question, $\beta$. In adherence to the Big Little Big Angle theorem, it is imperative that $\beta$ is not equal to $\alpha$; as a result, $\beta$ is offset by another angle $\varepsilon$. This relationship is demonstrated through the following equation, $$\beta=\alpha+\varepsilon$$

The sector angle between the hub and the diagonal fold can be determined using the interior angles. In line with Kawasaki's theorem, which dictates that all angles add up to $2\pi$ (radians), we can derive the following equation to calculate $\eta$.

$$\eta = \frac{\pi}{2} - \alpha - \frac{\epsilon}{2} = \frac{\pi}{n} - \frac{\epsilon}{2} = \delta_{planar}$$

As for $\omega$, simple geometric properties can be applied to determine its value. Knowing that the shape is a triangle, the following equation is used to find $\omega$.

$$\omega=\pi-\alpha-\alpha-\eta=\delta$$

$\gamma$ can also be determined similarly. The first offset angle from the hub, also known as the directional angle, results in a 180-degree fold when the line connecting both ends is folded. Additionally, the sector angle between the diagonal fold and the reverse fold line is also $\eta$.
Therefore, $$\gamma=\pi-\beta-\eta$$

As the reverse folds extend to the edges of the mirror, the lines continue to offset by a value of $\varepsilon$. Therefore, a value of $\delta$ can be determined where, $$\delta=\gamma+\varepsilon$$

Figure 2:
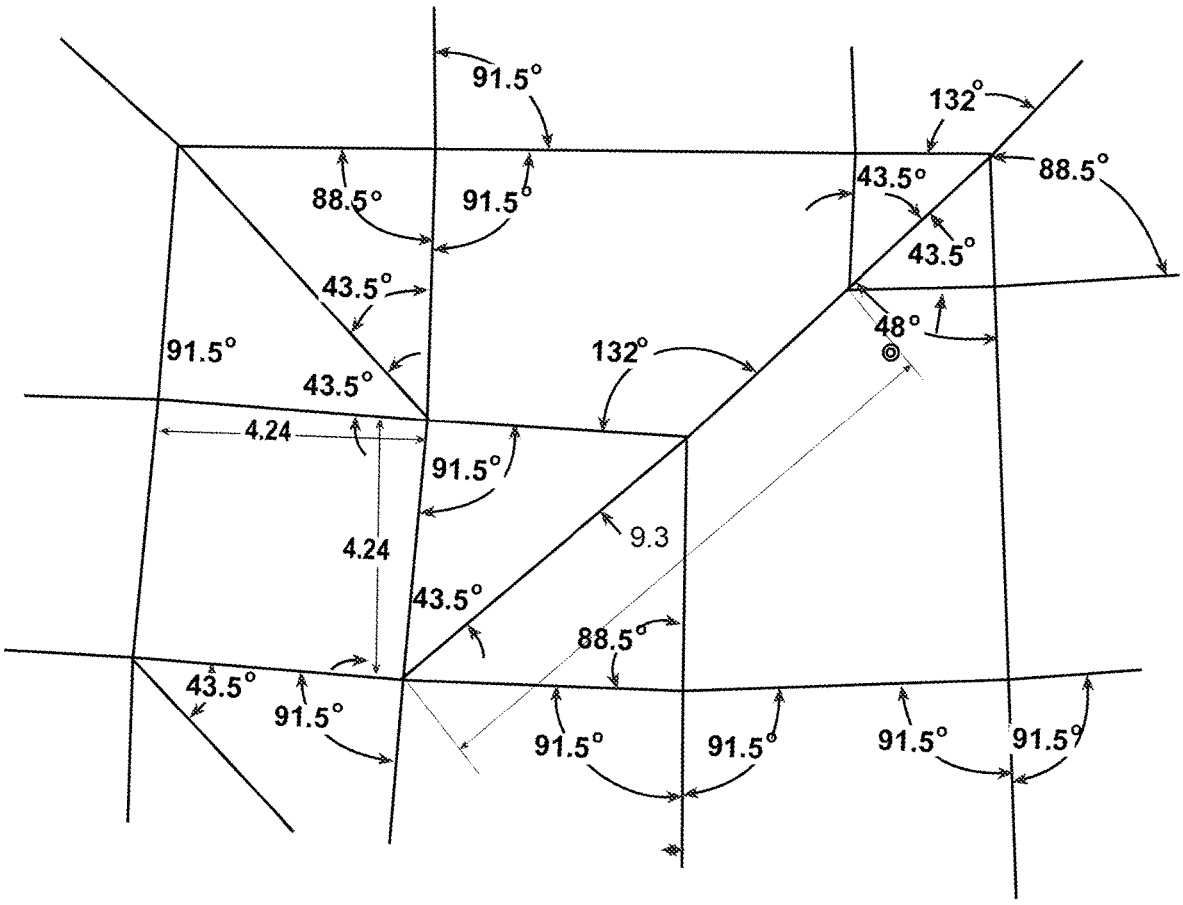
FIG. 2 Illustrates the angles of the Cube Flasher with respect to the Reverse Folds.

Finally, to create a flasher with a constant height, the following equation was used to space the diagonal reverse folds evenly throughout the flasher. This equation determines the total magnitude between two vectors that should add up to $d_k$ when arriving at the next node. FIG. 2 illustrates the hypotenuse of both vectors that add up to $d_k$.

$$d_k = h\cos\left(\frac{\epsilon}{2}\right)\sqrt{\csc\left(\frac{\pi}{n}\right)\csc\left(\frac{\pi}{n}-\epsilon\right)}$$

where $d_k$ is the distance between reverse folds, and h is the desired height of the 3-D flasher in cm. Note: The CAD modeling software is not limited to Solidworks.

To minimize the cost of the mirror, the main structure can be 3D printed using commonly available materials or fabricated via computer numerical control. High-performance thermoplastics, which are commercially accessible, can be used for lightweight applications. For a material to be considered suitable for space mission operations in a vacuum, it must meet the requirements listed in Table 1.

TABLE 1

Required Characteristics of Thermoplastics [15]

| List | Capable Characteristics |
|---|---|
| 1 | Low Outgassing in Vacuum |
| 2 | Long Life and Low Wear and Tear |
| 3 | Resistant to atomic oxygen |
| 4 | Reliable in Space for Temperature ranges of −160° C. to 160° C. |
| 5 | Reliable Mechanical Properties for Launch |
| 6 | Vibration Damping Capabilities |

Specific parameters required for the thermoplastic material can be obtained from reliable sources such as the National Aeronautics and Space Administration (NASA) or the European Space Agency (ESA). Table 2 presents a range of potential 3D printable thermoplastics suitable for space applications. Table 3 presents a range of potential metals suitable for space applications. The thermoplastic chosen for the 3-D printing of this space mirror was ULTEM-9085. The metal chosen for machining of this space mirror was Aluminum 6061.

TABLE 2

List of Possible Thermoplastics [15]

| List | Chemical Name |
|---|---|
| ULTEM (PEI) | Polythermide |
| PCTFE | Polychlorotrifluoroethylene |
| PTFE | Polytetrafluoroethylene |
| Vespel; SP and SCP Family | Polyimide |
| PEEK | Polyether ether ketone |
| Etc. | Etc. |

TABLE 3

| List of Possible Metals List |
|---|
| Aluminum 6061 |
| Aluminum 7075 |
| Inconel 718 |
| Titanium 6Al-4V |
| Etc. |

TABLE 4 lists different smart memory alloys (SMAs) applicable for engineering.
Table 3 List of Shape Memory Alloys [16]

| Element Base | Name |
|---|---|
| Copper Alloy | CuAlZn |
| | CuAlNi |
| | Etc. |
| Nickel-Titanium | Quasiequiatomic (Nitinol) |
| | NiTiCu |
| | NiTINb |
| | Etc. |

The SMA chosen needs to have similar characteristics to that of the host material as shown in Table 1. The SMA used for the Space Mirror is Nickel-Titanium with a percentage of cobalt. This chosen material is not limited to Elastic Nickel-Titanium as this is dependent on the structure's intended application.

Table 5 lists the required specifications for usable adhesive within the space environment. By using NASA's outgassing database, TC2810 was chosen and used on the Space Mirror.

TABLE 5

Required Characteristics for Applicable Adhesive [17]

| For Low Outgassing | |
|---|---|
| TML | <1% |
| CVCM | <0.1% |

The sketch starts by drawing a square with dimensions of 42.4 mm by 42.4 mm. Please refer to FIG. 2 for a visual representation. To construct a similar design, the following initial conditions, as indicated in Table 6, should be chosen for CubeSat applications.

Figure 3:
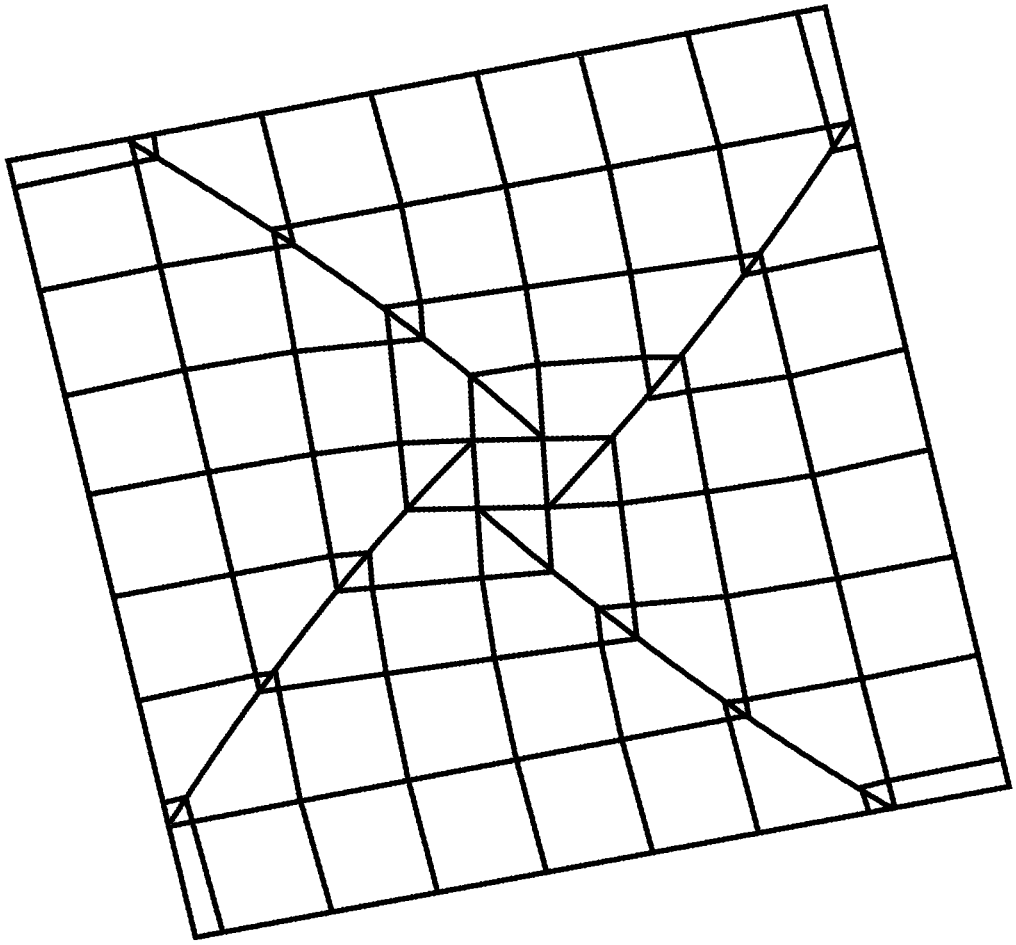
FIG. 3 Presents the Cube Flasher Sketch.

Table 7 contains the parameters utilized for the design. Sketch lines can be extended from the hub and intersected at the specified vertices with the applied angles. However, it should be noted that for the distance of the reverse folds, the sketch line is not the hypotenuse as shown in FIG. 2. Instead, the total magnitude of both vectors will add up to 9.464 cm. This process is then iteratively repeated until the full sketch forms a spiral pattern. Upon reaching the corners of the flasher, the corners are tapered off to form a 90-degree angle. Each bend fold will also be accompanied by a perpendicular edge. For a complete illustration of the sketch, please refer to FIG. 3.

TABLE 6

Cube Flasher Initial Conditions

| Parameter | Value |
|---|---|
| Sides of Hub (m) | 4 |
| Offset Angle ($\epsilon$) | 3° |
| Desired Height (h) | 6.5 cm |
| Center Diameter (cd) | 4.241 cm |

TABLE 7

Cube Flasher Angles and Reverse Fold Distance

| Parameter | Value |
|---|---|
| Inner Angle ($\alpha 1$) | 900 |
| $\alpha 2$ | 45° |
| $\beta 2$ | 48° |
| $\eta 2$ | 43.5° |
| $\gamma 2$ | 88.5° |
| $\delta 2$ | 91.5° |
| Distance between Reverse Folds (dk) | 9.464 cm |

The sketch was then scaled to a thickness of 1.27 mm. Each line in the sketch was widened to accommodate the panel-gap, which has a width of 2.4 mm. Additionally, Nitinol wire of 0.2 gauge were introduced, connecting from panel to panel at a 45-degree angle within pre-designed groves. To account for 3D printing error, these grooves were designed to be 0.61 mm in width. Moreover, to prevent overlapping, the grooves were set to be 15 mm in length. If not, 3D printed, these groves would be milled out after the CNC process.

Between each panel, an even number of grooves were added, where half of them would be perpendicular to the other half. All grooves were centered for each side of every panel. Additionally, if milled, all grooves were created on the side of the mountain fold. Therefore, both sides would have milled groves depending on the respective fold. To address the issue of the final folding state of the mirror being too wide, the outside ring of the sketch was removed. Additionally, small square shapes between the reverse folds and bend folds were eliminated in the final design to reduce stress within the 6-degree node points. The finalized 3D printing design, incorporating these modifications, is depicted in FIG. 4.

To fit a passive hinge in a 1.27 mm thick mirror, the wire needs to be 0.5 mm or 0.02 gauge. This allows for the wire to be snug within the Ultem-9085 or Aluminum-6061. Any smaller, and you begin to sacrifice material characteristics in comparison to thicker wire. Nitinol wire with this thickness has a maximum bending radius of 7 mm. To prevent a panel gap when folded, the groves were then shifted to a 45° allowing the panel gap to come to ~0 mm when folded at 180°. However, there is a concern that the Nitinol wire, when bent, might exert lateral forces on the mirror panels. These lateral forces could potentially cause misalignment or damage to the mirror structure. To counteract these lateral forces, additional grooves are introduced in the hinge design. These grooves are placed perpendicular to the initial grooves, effectively canceling out the lateral forces exerted by the Nitinol wire when the mirror is folded. The combination of the 45-degree shifted grooves, the panel gap, and the perpendicular grooves ensures that the hinge operates smoothly, preventing any gaps or extensive damage to the mirror panels during folding and unfolding. Please note that the specifics of FIG. 4 and the design details may vary depending on the actual product or context in which this passive hinge is being used.

Figure 4:
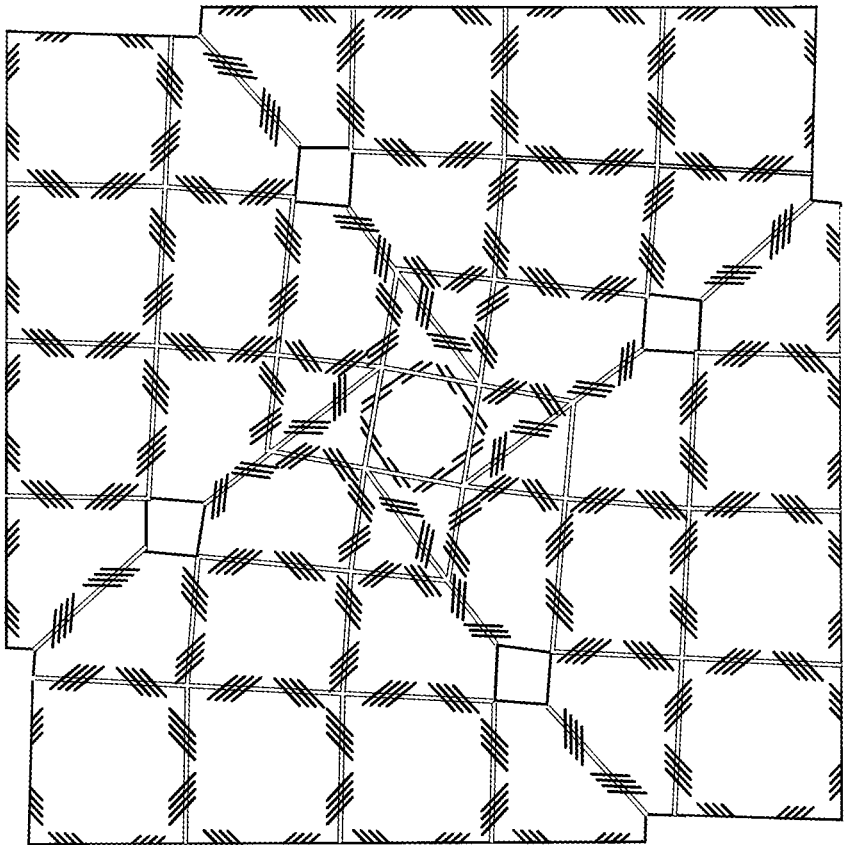
FIG. 4 Showcases the Final Cube Flasher design for CubeSat purposes.

Prior to 3-D printing or machining FIG. 4, the design includes small tabs connecting all the panels together to maintain the desired panel spacing during the printing or milling process. These tabs serve as temporary support and are intended to be removed after the implementation of the Nitinol wire.

Once the model is complete, there may be some excess material present within the grooves and panel gaps. To ensure a clean and precise fit for the Nitinol wire, a post-processing step is undertaken. A combination of a Flathead screwdriver and a soldering tool is used to carefully remove any excess ULTEM-9085 from the grooves and panel gaps. Using a CNC, this excess material can be removed from the metal structure. This process ensures that there are no obstructions that could hinder the insertion of the Nitinol wire. However, it is important to note that the tabs mentioned earlier are not removed during this step. They remain intact until the Nitinol wire is added, as they serve the purpose of maintaining the panel spacing during the post-processing stage.

Before cutting the Nitinol wire to the desired lengths, it is placed within a jar filled with 100% Isopropyl alcohol. The purpose of this step is to dissolve any excess manufacturing oil or residue present on the Nitinol wire. This ensures that the wire is clean and free from any potential contaminants before it is used in the hinge assembly.

After completing these preparations, the clean and oil-free Nitinol wire is ready to be carefully inserted into the grooves of the model, creating the passive hinge as described in FIG. 4. The combination of the 3-D printed model, the carefully inserted Nitinol wire, and the prior removal of excess material ensures a precise and functional hinge mechanism.

To enhance adhesion further, 100 grit sandpaper was run along the Nitinol wire before cutting to remove any remaining oil. Calipers were then set to 14.89 mm and measured from one end of the wire before cutting. The quantity given max of the wire is 15 mm. A total of 840 small Nitinol wires were cut, with a combined length of 12.6 meters. All the wires were placed within a crucible, which was subsequently positioned in a furnace at 100° C. for 10 seconds to allow the shape memory alloy (SMA) wires to straighten out. The Elastic Nitinol wire, if used, is not to be tampered with post cutting.

Next, using an adhesive gun, TC-2810, and a mixing nozzle, each grove was filled within the 3D printed model. The mixing nozzle was utilized to prevent air bubbles from forming within the adhesive mixture. One by one, a Nitinol wire was placed within each groove and allowed to cure for 48 hours. For the metal model, each Nitinol wire was placed within the grove and then pressed with a rounded bit to crimp the aluminum over the wire. TC-2810 was then added over the crimped gap for further adhesion. It's worth noting that when the mirror is folded, the front side would be considered the interior of the cube.

Subsequently, a commercial-grade reflective material was placed on the front side of the mirror. The entire assembly was then left to cure for another 48 hours to ensure complete solidification. With this, the mirror build process was concluded successfully.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A deployable origami structure comprising a plurality of panels and connectors, said connectors connecting each panel to at least one other panel in at least two spots, said connectors comprising an alloy that has the following properties: a melting point that is greater than 1000° C. and a relative density of 6.4 g/cm3 wherein said panels comprise a mirror material, an electromagnetic shielding material, a radar absorptive material, a thermal shielding material, a solar panel material, a laser shielding material, a light shielding material, a ballistic shielding material and a thermal camouflage material.

2. The deployable origami structure of claim 1 wherein said alloy comprises from about 40% to about 60% nickel, less than 3% Copper, Niobium or Cobalt the balance of said alloy b being Titanium.

3. The deployable origami structure of claim 2 wherein said alloy comprises from about 0.1% to about 3% Copper, Niobium or Cobalt.

4. The deployable origami structure of claim 3 wherein said alloy comprises from about 1% to about 3% Copper, Niobium or Cobalt.

5. The deployable origami structure of claim 1 wherein said alloy comprises less than 3% Niobium or Cobalt.

6. The deployable origami structure of claim 1 wherein said alloy comprises less than 3% Cobalt.

7. The deployable origami structure of claim 1 wherein said connectors are in the form of wires and/or sheets.

8. The deployable origami structure of claim 1 wherein a) said mirror material comprising Aluminum, Copper, Silver and/or Gold;

b) said electromagnetic shielding material comprises graphite and nickel-coated carbon composite fibers;

c) said radar absorptive material comprises a polymer matrix comprising embedded ferromagnetic particles;

d) said thermal shielding material comprises carbon nanofibers and/or ceramics;

e) said solar panel material comprises silicon and aluminum;

f) said laser shielding material comprises polycarbonates and/or acrylics;

g) said light shielding material comprises Kapton and/or vinyl polyester;

h) said ballistic shielding material comprises Kevlar and/or ceramics; and i) said thermal camouflage material comprises samarium nickel oxide and/or a phase-change material.

9. The deployable origami structure of claim 8 wherein said phase-change material comprises vanadium oxide and/or $Ge_3Sb_2Te_6$.

10. The deployable origami structure of claim 1 wherein said panels are:

a) squares and triangles;

b) rectangles and triangles;

c) trapezoids, squares and triangles; or d) trapezoids, rectangles and triangles.

11. The deployable origami structure of claim 10 wherein said panels are:

a) squares and triangles, said squares comprising 1 to 3 rounded corners b) rectangles and triangles, said rectangles comprising 1 to 3 rounded corners;

c) trapezoids, squares and triangles, said trapezoids and/or squares comprising 1 to 3 rounded corners; or d) trapezoids, rectangles and triangles, said trapezoids and/or rectangles comprising 1 to 3 rounded corners.

12. The deployable origami structure of claim 1 wherein said connectors are glued, welded and/or crimped to said panels or within to said panels.

13. An article comprising the deployable origami structure of claim 1, said article being an aerospace vehicle or a land vehicle.

14. The article of claim 13 wherein, said aerospace vehicle is a satellite and said land vehicle is a main battle tank, infantry fighting vehicle, armored personnel vehicle, armored combat support vehicle, mine protected vehicle, light armored vehicle or light utility vehicle.

15. The article of claim 14 wherein, said satellite is an inspector CubeSat, or an Evolved Expendable Launch Vehicle Secondary Payload Adapter Satellite.

16. A process of making a deployable origami mirror structure said process comprises connecting a plurality of panels with a plurality of connectors, said connectors connecting each panel to at least one other panel in at least two spots, said connectors comprising an alloy that has the following properties a melting point that is greater than 1000° C. and a relative density of 6.4 g/cm3 wherein said panels comprise a mirror material, an electromagnetic shielding material, a radar absorptive material, a thermal shielding material, a solar panel material, a laser shielding material, a light shielding material, a ballistic shielding material and a thermal camouflage material.

17. The process of claim 16, wherein said connectors are glued, welded and/or crimped to said panels or within to said panels.

18. The process of claim 16, wherein said connectors are in the form of wires and/or sheets.

19. The process of claim 16 wherein:

a) said mirror material comprising Aluminum, Copper, Silver and/or Gold;
b) said electromagnetic shielding material comprises graphite and nickel-coated carbon composite fibers;
c) said radar absorptive material comprises a polymer matrix comprising embedded ferromagnetic particles;
d) said thermal shielding material comprises carbon nanofibers and/or ceramics;
e) said solar panel material comprises silicon and aluminum;
f) said laser shielding material comprises polycarbonates and/or acrylics;
g) said light shielding material comprises Kapton and/or vinyl polyester;
h) said ballistic shielding material comprises Kevlar and/or ceramics; and
i) said thermal camouflage material comprises samarium nickel oxide and/or a phase-change material.

20. The process of claim 16 wherein said panels are:

a) squares and triangles, said squares comprising 1 to 3 rounded corners
b) rectangles and triangles, said rectangles comprising 1 to 3 rounded corners;
c) trapezoids, squares and triangles, said trapezoids and/or squares comprising 1 to 3 rounded corners; or
d) trapezoids, rectangles and triangles, said trapezoids and/or rectangles comprising 1 to 3 rounded corners.

* * * * *